United States Patent [19]

Swann

[11] Patent Number: 5,024,427

[45] Date of Patent: Jun. 18, 1991

[54] QUICK-CHANGE HEAD FOR PRECISION MACHINE VISE

[76] Inventor: George R. Swann, 336 Old Babcock Trail, Gibsonia, Pa. 15044

[21] Appl. No.: 306,511

[22] Filed: Feb. 6, 1989

[51] Int. Cl.[5] ..... B25B 1/10

[52] U.S. Cl. ..... 269/136; 269/154; 269/283

[58] Field of Search ..... 269/261, 279–284, 269/244, 88, 152, 154

[56] References Cited

U.S. PATENT DOCUMENTS

| | | | |
|---|---|---|---|
| 463,332 | 11/1891 | Giles | 269/261 |
| 1,393,083 | 10/1921 | Campbell | 269/283 |
| 1,550,751 | 8/1925 | Sinkler | 269/283 |
| 3,565,417 | 2/1971 | Degle | 269/281 |
| 4,019,726 | 4/1977 | Turner | 269/261 |
| 4,043,547 | 8/1977 | Glomb et al. | 269/244 |
| 4,170,345 | 10/1979 | Towsend | 269/88 |
| 4,685,663 | 8/1987 | Jorgensen | 269/244 |
| 4,779,857 | 10/1988 | Mound | 269/282 |

*Primary Examiner*—Robert C. Watson
*Attorney, Agent, or Firm*—Kirkpatrick & Lockhart

[57] ABSTRACT

A precision machine vise is provided with quick-change head members or means to facilitate the changeover from making one kind of part to another, preferably in equipment provided with computer numerical control. The precision machine vise is of the kind having obliquely oriented surfaces as an anti-cocking measure. One first part of the equipment supported by the base of the precision machine vise has an upstanding boss, and a second part of the equipment containing jaw plates in contact with the work has a vertical bore in which said boss fits, and there is a horizontal bore through the boss of the first part and through the second part, into and through which a locking-in means fits. The first part is provided with means to minimize play between the first part and the second. The second part mentioned above may be a disposable item. For use with a precision machine vise of the two-place type, there is also provided a changeable "fixed" central member, securable to the base via bolts accessible from above.

15 Claims, 2 Drawing Sheets

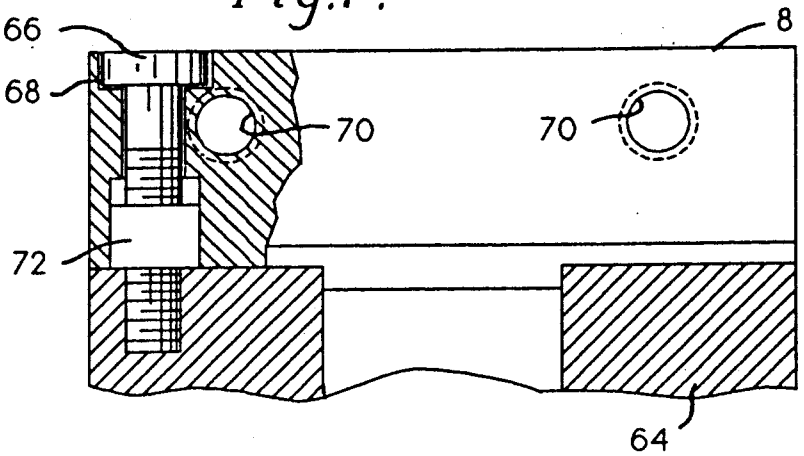
Fig.7.
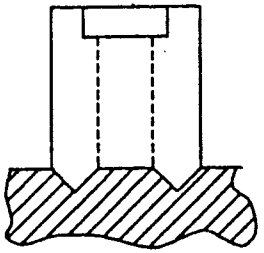
Fig.9.
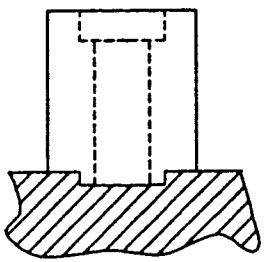
Fig.8.
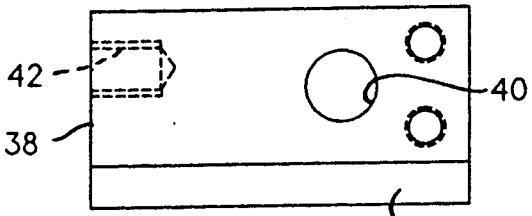
Fig.4.
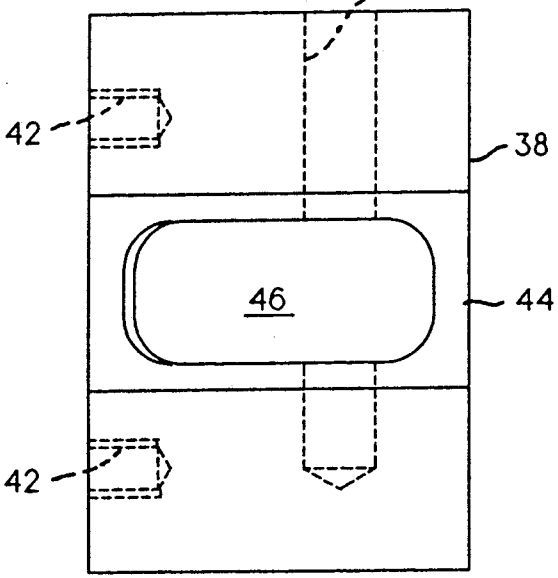
Fig.5.
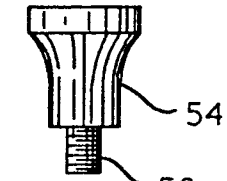
Fig.6.
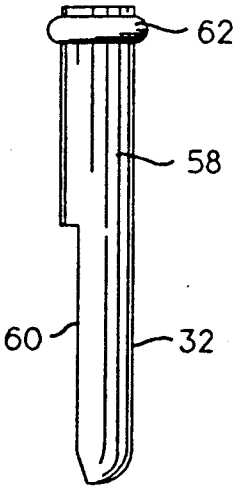

QUICK-CHANGE HEAD FOR PRECISION MACHINE VISE

BACKGROUND OF THE INVENTION

1. Field of the Invention

This invention relates to machining of workpieces held in a precision machine vise, and more particularly, to a particular form of vise, which is of such construction as to permit the use of any of a multiplicity of replaceable quick-change head members. In one aspect of the invention, there is provided, moreover, a machine vise with a structure such that it is also possible to replace quickly and conveniently its fixed jaw member. The invention relates more particularly to apparatus of the above kind in which a changeover is made especially quick and convenient by reason of the use of a locking-pin member or means. The invention includes in its field certain method aspects with reference to the apparatus or equipment mentioned above, and in this regard, it includes particularly a method for precision-machining workpieces with the use of disposable replaceable head members associated with the movable jaw or jaws of the apparatus or equipment.

2. Description of the Prior Art

In the art of machining workpieces which are held in precision machine vise and are worked upon by means of so-called "numerical-controlled machining equipment", it has hitherto been a common practice to provide the working faces of a precision machine vise, that is, the surfaces of the vise which grasp the work, with replaceable jaw plates. These are sometimes called "soft plates", being as they are made of a metal which is somewhat softer and more machinable than the body of the metal comprising the jaws of the vise. In dealing with the making of a number of identical parts with the use of the above-mentioned numerical-control equipment, it is common practice to machine into the replaceable jaw-face plates some appropriate recesses or niches to receive a workpiece in such a way that its position is precisely known and established.

What has been said above is equally applicable, whether the precision machine vise is a one-place or a two-place vise. Those skilled in the art are aware that in the automatic or numerical control machining of workpieces, there are known (for purposes of obtaining a greater output of finished pieces per unit of time) some precision machine vises which have a central fixed member, which has the replaceable jaw plates on both sides of it, and then also first and second movable cooperating jaw members, which are themselves also then provided with replaceable jaw-plate members which grasp the work. In U.S. Pat. No. 4,529,183, there is disclosed a two-place precision machine vise of this kind. But whether the precision machine vise which is being used is of this two-place type or of the older one-place type, one of the problems facing the operator of the equipment remains essentially the same: there is a certain amount of time lost or expended in going from the machining of one kind of part (or one set of kinds of parts) to another, and most particularly, there is time lost or expended in getting properly set up again, perhaps some days or weeks later, to resume the making of one particular kind of finished workpiece. Though it is usual, in a job machine shop, to save for later use the particular replaceable jaw plates which have in them the correctly sized and positioned niches or recesses for holding the starting workpieces which are used for the making of a particular kind of finished workpiece, there is relatively frequently some difficulty about getting them correctly and accurately and securely attached to their respective jaw members so that the production of the desired kind of finished workpiece may then be resumed. Instead, too often, when the replaceable jaw plates are reinserted in the precision machine vise, they are less than "exactly right", which is the same as "not right at all"--new replaceable jaw plates will need to be made and used. The prior art has lacked any teaching of how to make a precision machine vise of the kind indicated above which contains structural features such that there are, especially in the precision machine vises that exhibit the feature of having appropriate obliquely oriented bearing surfaces as an anti-tilt or anti-cocking measure, appropriately designed jaw members which are adapted to have inserted thereon and to have removed therefrom head members to which the jaw members for contacting the workpieces may be kept securely in place. The prior art has not afforded a structure which makes it possible, simply by snapping into place a suitable set of heads and securing them with appropriate locking-pin members, to resume to making of a particular kind of desired part after a gap of some days or weeks, avoiding any chance of substantial lost time in so doing.

The prior art has also, accordingly, lacked any concept of providing a machine vise with quick-change replaceable heads which may be treated as disposable items, having work-contacting jaw faces with appropriately located niches or recesses machined thereinto. The prior art has lacked having such heads be given one, a few, or several stanzas of use, and then discarded.

SUMMARY OF THE INVENTION

In accordance with a particular preferred form of the invention, there is made a precision machine vise of the kind containing obliquely oriented surfaces as an anti-tilt or anti-cocking measure, which precision machine vise is further characterized in that there is a portion of the movable jaw member or members which remain in place as a part of the assembled vise which is in the form of an upstanding boss or projection which is adapted to receive snugly a cooperating replaceable head member (to which the jaw plate face in contact with the workpiece is securely affixed or integrally joined), with the upstanding boss or projection also having the features of (a) having a generally hemicylindrical bore therethrough (in a direction crossways of the motion of the jaw members towards and away from each other) which affords an appropriately oriented obliquely extending bearing surface and is adapted to receive snugly a correspondingly shaped locking-pin member, and (b) having also operatively associated therewith a spring pin or similar biasing or loading means to combat any tendency for the head member to move in a direction parallel to the motion of the jaw members when the vise is being tightened or loosened. With such a boss or projection, and its cooperating replaceable head, and an appropriately dimensioned and shaped locking-pin means or member, there is obtained a structure which affords (at least as respects the movable jaw portions) a precision machine vise having the advantages that can be obtained with quick-change heads, whether they are to be considered disposable or relatively permanent. Desirably, in a two-place precision machine vise of this type, some provision is also made for the relatively rapid and convenient changing or replacement of the central "fixed" jaw, and in accordance with one aspect of the invention, this is preferably done by providing a replaceable fixed-jaw member which is adapted to be affixed to or removed from the remainder of the precision machine vise by tightening or loosening bolts or other appropriate fastening means from above, with the fixed jaw members containing in their bottoms counterbored portions which are adapted to receive snugly some sleeve members affixed thereto, as, for example, with epoxy glue: when it is time to replace the fixed jaw member, the above-mentioned bolts are rotated in a proper direction and the sleeve members bear upon the replaceable fixed jaw member, urging it upward.

DESCRIPTION OF THE DRAWINGS

A complete understanding of the invention may be obtained from the foregoing and following description thereof, taken in conjunction with the appended drawings, in which:

FIG. 4 is a side elevation view of a top part of a movable member, according to the present invention;

FIG. 5 is a bottom view of the part of FIG. 4;

FIG. 6 is a side view of a locking pin means which is adapted to be inserted through and to secure together the above-mentioned bottom part of FIGS. 2 and 3 and the abovementioned top part of FIGS. 4 and 5;

FIG. 7 is an elevation view, partly diagrammatic, partly in section, of a fixed member 8 of a precision machine vise according to the invention;

FIG. 8 is a representation of a known way of connecting a fixed jaw to the vise base; and FIG. 9 is a similar representation of a preferred way of connecting a fixed jaw to the vise base.

DESCRIPTION OF THE PREFERRED EMBODIMENTS

Figure 1:
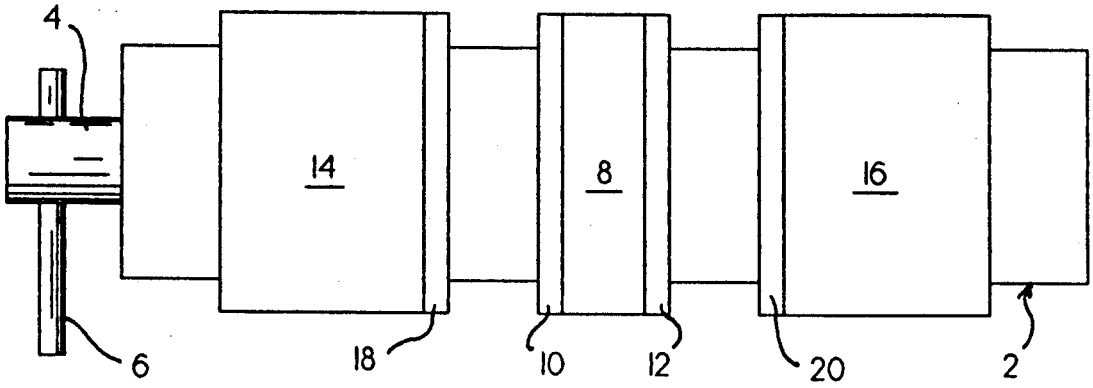
FIG. 1 is a schematic overall plan view of a two-place precision machine vise in accordance with the invention.

In FIG. 1, there is represented a schematic plan view of a two-place precision machine vise indicated generally at 2. This is a vise of a kind adapted to be used with computer numerical control machinery, such as is used in job machine shops for the making of different quantities of workpieces of various kinds. The precision machine vise 2 is shown as having, extending from one end thereof, a member 4 which is provided with means 6 for causing it to be rotated. As is familiar to those skilled in the art, the member 4 is suitably journaled or supported so that it may be rotated and so that, moreover, it may move axially in the direction of the length of the precision machine vise 2. This being a two-place precision machine vise, it is provided with a fixed central member 8 having jaw plates 10 and 12, and movable members 14 and 16, having jaw plates 18 and 20, respectively. The movable members 14 and 16 have engagement with the elongated member 4 such that the member 4 threadedly engages the member 16 and has an enlarged portion (not shown) which bears against the member 14, such that by rotating the member 4 with the use of the means 6, the movable member 16 with its jaw plate 20 is brought in against a first workpiece, held between the jaw plates 12 and 20, and then, upon further rotation of the member 4 in the same sense, the member 4 begins to move axially, eventually moving in the direction of the movable member 16 a sufficient distance that its enlarged portion bears against the movable member 14 and causes a second workpiece to be grasped between the jaw plates 18 and 10. As was explained in U.S. Pat. No. 4,529,183, use of such a two-place precision machine vise greatly accelerates the production of workpieces which need to be machined while held or grasped first through one dimension and then through a different dimension.

The present invention relates to an improvement of and in precision machine vise machinery of the kind indicated above in accordance with a preferred embodiment of which the "fixed" central member 8 is so made that it can be conveniently changed, being secured to the remainder of the precision machine vise 2 by means of bolts accessible from above. Moreover, in accordance with the present invention, at least one and preferably both of the movable members 14 and 16 are of such construction that they are provided with quick change heads, as will be more particularly described hereinbelow.

Figure 2:
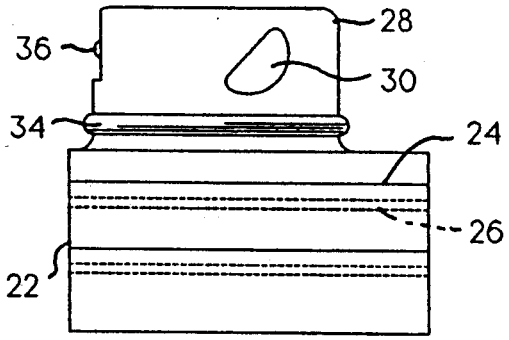
FIG. 2 is an elevation view from the side of a bottom part of a movable member, according to the present invention, in a precision machine vise of the kind shown in FIG. 1.
Figure 3:
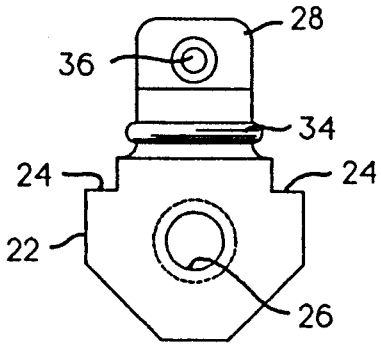
FIG. 3 is an elevation view from the end of a bottom part as shown in FIG. 2.
Figure 11:
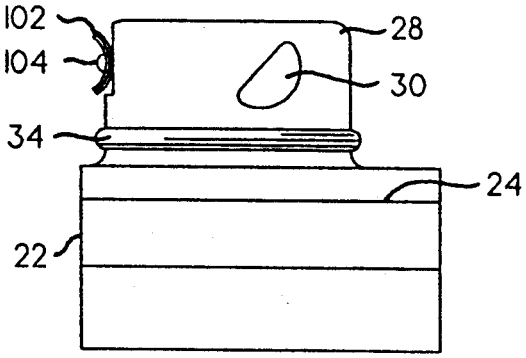
FIG. 11 is a side elevation view of a moveable member according to another embodiment of the invention.
Figure 10:
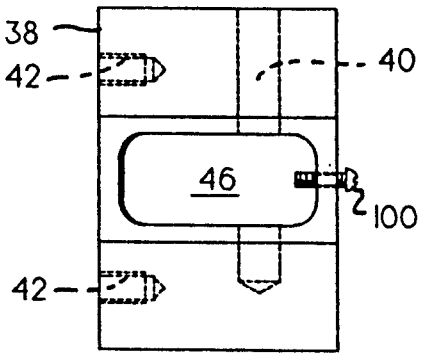
FIG. 10 is a bottom view of another embodiment of present invention.

Referring now to FIGS. 2 and 3, there are shown therein a side view and an end view of a bottom part 22 of a movable member 16 as shown in FIG. 1. The surfaces 24 slide on rails (not shown) which run the length of the precision machine vise 2, as the member 4 turns within the internally threaded opening 26. The part 22 has an upstanding boss or projection 28, which has running through it a transversely extending generally hemispherical opening or bore 30, seen in FIG. 2, to permit the passage therethrough of a locking-pin means 32, more particularly shown and described hereinbelow in FIG. 6. The boss or projection 28, if seen in plan view, is generally rectangular in shape. Near its bottom, there is provided a suitable resilient seal 34, which sits in a groove provided to receive it. To complete the description of the bottom part 22, it is necessary to mention the spring-pin means 36 in one of the vertically extending faces of the boss or projection 28.

Referring now to FIGS. 4 and 5, these show a side elevation view and a bottom view of a top part 38 of the movable member 16. There is a transverse circular bore 40 extending therethrough, for receiving the above-mentioned locking-pin means 32. Threaded cavities 42 are provided so that jaw plates can be affixed to the part 38. The piece 38, when seen in an elevation view corresponding to FIG. 4, is generally T-shaped, with a heavy transverse top and a relatively smaller downwardly projecting portion 44. A cavity 46 is provided which is of such dimensions as to permit the above-mentioned upstanding boss or projection 28 of the part 22 to be snugly received therein.

The locking-pin means 58 is shown in an exploded view in FIG. 6. It has, preferably, at one end a knob portion 54 having connected therewith a threaded projection 56, by means of which it may be screwed into a suitably threaded cavity (not shown in the interest of simplicity) in the main part 58 of the locking-pin means 32. The main part 58 of the locking pin means 32 is generally round in cross section, but the locking-pin means 32 has a planar portion 60 which is adapted to be brought into contact with the interior of the flat or diameter side of the hemicylindrical bore 30 in the boss 28; this is done to afford an obliquely extending bearing surface which tends to provide a desirable anti-tilt or anti-cocking action to the precision machine vise. FIG. 6 further shows a seal ring 62.

It will be apparent to those skilled in the art how similar structure may be likewise provided with respect to the movable member 14.

Referring now to FIG. 7, there is shown a "fixed member" 8, and how it is secured to the base 64 of the precision machine vise 2 by means of a bolt 66 which is accessible from above. It will be understood that a plurality of such bolts are provided, but only one is shown in the interest of simplicity. The gap 68 between the bolt 66 and its surroundings has been exaggerated in the interest of clarity. At 70, there are indicated the tapped holes, by means of which the jaw plates, such as 10 and 12, may be secured to the part 8. The bolt 66 is not only threaded into the base 66 but also is engaged by a locking washer 72 which is received snugly in a bore of corresponding size in a bottom part of the removable or changeable member 8.

MODIFICATIONS AND EQUIVALENTS

It is to be understood that there may or may not be jaw plates affixed to the quick-change head, and moreover, when jaw plates are provided, they may be affixed to and detached from the head in any desired feasible manner. That is to say, though they may be attached in the conventional manner with screws or bolts, they may also be attached in some other way, such as the use of cam bolts or by some species of quick-change connection, such as the matching of a keyhole-shaped bore with a suitably shaped bayonet pin. It is preferable, however, in many instances to avoid the use of jaw plates altogether, since that increases the bearing surface available to bear upon the workpiece being secured within the vise and it eliminates the problems associated with avoiding having the tool come into contact with the head of a screw or bolt.

As a way of causing the joining the "fixed" head of a two-place precision machine vise to the base of such vise, the parts to be joined together may, of course, be fitted together in the standard tongue-and-groove manner, as illustrated in FIG. 8, but preferably, they will be joined by means of a set of matching grooves or corrugations, as illustrated in FIG. 9. The structure of the latter FIGURE is preferable because it tends to overcome the problems of loosening that are encountered because of wear. Moreover, the effort required to dislodge a first piece 8 and insert a second one is very substantial in the case of the connection of the style illustrated in FIG. 8, whereas making and unmaking such as connection is far easier in the case of a connection as shown in FIG. 9. The idea of so joining the central fixed jaw member of a two-place vise in this manner is one that has application apart from its use in conjunction with providing one or more movable jaws of a vise, preferably a precision machine vise, with quick-change heads that are secured by locking-pin means. Such a structure may indeed be useful in the case of any two-place vise.

In order to minimize the free-play between bottom part or element 22 and top element 38, a set screw 100 may be provided to pass through a bore through one end of the top element 38 and engage the upstanding projection 28. Alternatively, in place of the spring-pin 36 on the upstanding projection 28, cupped spring washers or tension springs 102 may be provided which are supported on a guide pin 104 mounted in a bore in upstanding projection 28. As such, the tension springs 102 may engage the recess 46 in the upper member 38.

While I have shown and described herein certain embodiments of my invention, I intend to cover as well any change or modification therein which may be made without departing from the spirit and scope of the invention.

I claim as my invention:

1. In a machine vise having a base, a first jaw secured to said base and a second jaw supported on said base for movement toward and away from said first jaw, the improvement which comprises:

a. said second jaw comprises:

1. a first element having an extended member having a first bore extending tranversely through said extended member, said first bore having a flat surface therethrough, said flat surface between disposed at an angle such that said flat surface faces in a direction that is toward said base and toward said first jaw; and 2. a second element having a recessed area adapted to receive said extended member, said second element having a second bore aligned with said first bore; and b. a removable locking pin adapted for axial insertion into both of said second bore and said first bore, said removable locking pin having a planar portion that substantially corresponds to said flat surface of said first bore for engagement therewith to thereby couple said second element to said first element and said locking pin being further adapted for axial removal from said first and said second bores to uncouple said second element from said first element.

2. An improvement as defined in claim 1, wherein one of said first and second elements also contains means for minimizing free play between them.

3. An improvement as defined in claim 2, wherein said means for minimizing free play between said first and second elements is a spring pin.

4. An improvement as defined in claim 2, wherein said means for minimizing free play between said first and second elements is a set screw.

5. An improvement as defined in claim 2, wherein said means for minimizing free play between said first and second elements is a tension washer.

6. An improvement as defined in claim 2, where said vise is a vise having a replaceable central member secured to the 7. An improvement as defined in claim 2, where said vise is a vise capable of separately holding two workpieces on the opposite sides of a replaceable central member secured to the base of said vise by means accessible from above.

8. An improvement as defined in claim 7, wherein said replaceable central member has, in surface-to-surface contact with the base of the vise, a plurality of corresponding tapered surfaces, whereby a desired degree of rigidity of connection may be established and maintained while affording a structure capable of ready attachment and disassembly.

9. An improvement as defined in claim 1, wherein said vise is a precision machine vise, and said locking-pin means is snugly received in said bores.

10. An improvement as defined in claim 9, wherein one of said first and second elements also contains means for minimizing free play between them.

11. An improvement as defined in claim 10, wherein said means for minimizing free play between said first and second elements is a spring pin.

12. An improvement as defined in claim 10, wherein said means for minimizing free play between said first and second elements is a set screw.

13. An improvement as defined in claim 10, wherein said means for minimizing free play between said first and second elements is a tension washer.

14. An improvement as defined in claim 10, where said vise is a vise capable of separately holding two workpieces on the opposite sides of a replaceable central member secured to the base of said vise by means accessible from above.

15. An improvement as defined in claim 14, wherein said replaceable central member has, in surface-to-surface contact with the base of the vise, a plurality of corresponding tapered surfaces, whereby a desired degree of rigidity of connection may be established and maintained while affording a structure capable of ready attachment and disassembly.

* * * * *

UNITED STATES PATENT AND TRADEMARK OFFICE

CERTIFICATE OF CORRECTION

PATENT NO. : 5,024,427
DATED : June 18, 1991
INVENTOR(S) : George R. Swann

It is certified that error appears in the above-identified patent and that said Letters Patent is hereby corrected as shown below:

On the title page:
In the Abstract, line 13, delete "locking-in" and substitute --locking-pin-- therefor.

Col. 3, line 36, delete "abovementioned" and substitute --above-mentioned-- therefor.

Col. 3, line 45, before "present" add --the--.

Col. 6, line 19, delete "tranversely" and substitute --transversely-- therefor.

Col. 6, lines 21 and 22, delete "between" and substitute --being-- therefor.

Col. 6, line 53, after "the" add --base by means accessible from above.--

Signed and Sealed this

Twenty-third Day of February, 1993

*Attest:*

STEPHEN G. KUNIN

*Attesting Officer*

*Acting Commissioner of Patents and Trademarks*